US010682859B2

(12) United States Patent
Okawa et al.

(10) Patent No.: US 10,682,859 B2
(45) Date of Patent: Jun. 16, 2020

(54) MULTIFUNCTION PERIPHERAL

(71) Applicant: SEIKO EPSON CORPORATION, Tokyo (JP)

(72) Inventors: Soshi Okawa, Shiojiri (JP); Shoma Kudo, Shiojiri (JP); Nobuyuki Nishi, Hara (JP); Munehide Kanaya, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/371,844

(22) Filed: Apr. 1, 2019

(65) Prior Publication Data

US 2019/0224976 A1 Jul. 25, 2019

Related U.S. Application Data

(63) Continuation of application No. 15/398,526, filed on Jan. 4, 2017, now Pat. No. 10,293,613.

(30) Foreign Application Priority Data

Jan. 29, 2016 (JP) ..... 2016-015319

(51) Int. Cl.
*B41J 2/175* (2006.01)
*B41J 29/13* (2006.01)

(52) U.S. Cl.
CPC ..... *B41J 2/175* (2013.01); *B41J 29/13* (2013.01)

(58) Field of Classification Search
CPC .... B41J 2/175; B41J 2/17509; B41J 2/17513; B41J 2/1752
See application file for complete search history.

(56) References Cited

U.S. PATENT DOCUMENTS 6,961,152 B1 * 11/2005 Watanabe ..... H04N 1/00543 358/296
7,607,769 B2 10/2009 Umeda et al.
7,688,485 B2 3/2010 Chen et al.
8,807,723 B2 8/2014 Aoki et al.
8,995,036 B2 3/2015 Ishida
9,044,972 B2 6/2015 Aoki et al.
(Continued)

FOREIGN PATENT DOCUMENTS

CN 1636750 A 7/2005
JP 2007036605 A 2/2007
(Continued)

*Primary Examiner* — John Zimmermann
(74) *Attorney, Agent, or Firm* — Workman Nydegger

(57) ABSTRACT

An recording device includes a recording head that performs recording using ink; a liquid containing body that is capable of accommodating ink; a casing of which at least the recording portion and the liquid containing body are provided on an inside portion; a tube that connects the liquid containing body and the recording head with each other; and a operating panel that constitutes a portion of an outer covering of the recording device and operates the recording device. The operating panel is provided to be capable of performing an opening/closing operation with respect to the casing between two positions which are an opened position which exposes and a closed position which does not expose an inside of the casing, and at least a portion of the liquid containing body is exposed, by an opening operation of the operating panel.

20 Claims, 10 Drawing Sheets

(56) References Cited

U.S. PATENT DOCUMENTS

| | | | | |
|---|---|---|---|---|
| 9,233,546 | B2 | 1/2016 | Oya et al. | |
| 9,233,547 | B2 | 1/2016 | Mizutani et al. | |
| 9,266,340 | B2 | 2/2016 | Oya et al. | |
| 9,321,272 | B2 | 4/2016 | Mizutani et al. | |
| 9,346,277 | B2 | 5/2016 | Oya et al. | |
| 9,487,014 | B2 | 11/2016 | Aoki et al. | |
| 9,505,224 | B2 * | 11/2016 | Kimura | B41J 2/17509 |
| 9,511,594 | B2 | 12/2016 | Shiota et al. | |
| 9,579,900 | B2 | 2/2017 | Oya et al. | |
| 9,682,565 | B2 | 6/2017 | Mizutani et al. | |
| 9,682,566 | B2 | 6/2017 | Mizutani et al. | |
| 9,694,588 | B2 | 7/2017 | Shiota et al. | |
| 9,844,945 | B2 | 12/2017 | Shiota et al. | |
| 10,220,627 | B2 | 3/2019 | Shiota et al. | |
| 10,220,628 | B2 | 3/2019 | Shiota et al. | |
| 2004/0196512 | A1 | 10/2004 | Chen et al. | |
| 2005/0036165 | A1 * | 2/2005 | Jia | H04N 1/2104 358/1.13 |
| 2005/0151782 | A1 | 7/2005 | Ishida et al. | |
| 2005/0281597 | A1 * | 12/2005 | Ito | G03G 15/6573 399/395 |
| 2006/0082622 | A1 | 4/2006 | Yonekawa et al. | |
| 2007/0024924 | A1 | 2/2007 | Ikeno | |
| 2008/0030530 | A1 | 2/2008 | Ishida et al. | |
| 2008/0297571 | A1 | 12/2008 | Umeda | |
| 2013/0169720 | A1 | 7/2013 | Nakamura et al. | |
| 2013/0307908 | A1 | 11/2013 | Aoki et al. | |
| 2014/0043385 | A1 | 2/2014 | Nakano et al. | |
| 2014/0071498 | A1 | 3/2014 | Ishida | |
| 2014/0313272 | A1 | 10/2014 | Aoki et al. | |
| 2015/0165773 | A1 | 6/2015 | Shiota et al. | |
| 2015/0165775 | A1 | 6/2015 | Oya et al. | |
| 2015/0165776 | A1 | 6/2015 | Oya et al. | |
| 2015/0165777 | A1 | 6/2015 | Mizutani et al. | |
| 2015/0165780 | A1 | 6/2015 | Shiota et al. | |
| 2015/0165781 | A1 | 6/2015 | Mizutani et al. | |
| 2015/0246548 | A1 | 9/2015 | Aoki et al. | |
| 2015/0283832 | A1 | 10/2015 | Osakabe et al. | |
| 2016/0039211 | A1 | 2/2016 | Oya et al. | |
| 2016/0089891 | A1 | 3/2016 | Mizutani et al. | |
| 2016/0089892 | A1 | 3/2016 | Mizutani et al. | |
| 2016/0229193 | A1 | 8/2016 | Oya et al. | |
| 2016/0243842 | A1 | 8/2016 | Shiota et al. | |
| 2017/0087859 | A1 | 3/2017 | Miyamoto et al. | |
| 2017/0151795 | A1 | 6/2017 | Shiota et al. | |
| 2018/0015727 | A1 | 1/2018 | Shiota et al. | |

FOREIGN PATENT DOCUMENTS

| | | |
|---|---|---|
| JP | 2008-296508 A | 12/2008 |
| JP | 2013-146997 | 8/2013 |
| JP | 2013-240924 | 12/2013 |
| JP | 2014-053760 | 3/2014 |
| JP | 2015-145089 | 8/2015 |
| WO | 2015136868 A | 9/2015 |

* cited by examiner

MULTIFUNCTION PERIPHERAL

BACKGROUND

1. Technical Field

The present invention relates to a recording device which performs recording using liquid and a multifunction peripheral in which an image reading device is disposed on the recording device.

2. Related Art

In the related art, a multifunction peripheral is known which is disposed to overlap an image reading device capable of reading an image on an upper side of a recording device which performs recording on a medium using ink as an example of liquid. An ink jet printer (multifunction peripheral) is disclosed in which an image reading unit (image reading device) is provided to be capable of performing an opening/closing operation with respect to the casing of an image forming portion (recording device) between two positions which are an opened position which exposes and a closed position which does not expose an inside of the casing thereof in Japanese Patent No. 4941110 as an example of the multifunction peripheral. In addition, the ink jet printer includes a recording head which discharges ink toward paper (medium) and a main tank which accommodates ink supplied to the recording head in the inside of the casing of the image forming portion.

By the way, in a case of an ink jet printer in Japanese Patent No. 4941110, when the amount of ink accommodated in a main tank is less, ink is poured into an inside of the main tank from a replenishing port included in the main tank. At this time, there is a need to expose an inside of a casing of an image forming portion by performing an opening operation of an image reading unit from a closed position to an opened position thereof for accessing to the main tank disposed in the inside of the casing of the image forming portion by a user. Typically, an opening/closing operation of the image reading unit for each replenishment of ink becomes a burden for the user since weight of the image reading unit is heavy.

SUMMARY

An advantage of some aspects of the invention is to provide a multifunction peripheral that is capable of easily accessing to a liquid containing body which is provided in a recording device having an image reading device on an upper side thereof and accommodates a recording liquid.

Hereinafter, means of the invention and operation effects thereof will be described.

An recording device includes a recording portion that performs recording using liquid; a liquid containing body that is capable of accommodating liquid supplied to the recording portion; a casing of which at least the recording portion and the liquid containing body are provided on an inside portion; a tube that connects the liquid containing body and the recording portion with each other; and a operating panel that constitutes a portion of an outer covering of the recording device and operates the recording device. The operating panel is provided to be capable of performing an opening/closing operation with respect to the casing between two positions which are an opened position which exposes and a closed position which does not expose an inside of the casing, and at least a portion of the liquid containing body is exposed, by an opening operation of the operating panel.

According to the configuration, the liquid containing body disposed in the casing is exposed, by the opening operation of the operating panel. Therefore, it is possible to easily access to the liquid containing body which accommodates a recording liquid and is provided on an inside portion of the recording device of which an image reading device is disposed on an upper side.

In the recording device, the liquid containing body may include a pouring port which is capable of pouring liquid into an inside thereof and the pouring port may be exposed, by the opening operation of the operating panel.

According to the configuration, liquid can be poured into the liquid containing body disposed on the casing without an opening operation of the image reading device, since the pouring port of the liquid containing body is exposed, by the opening operation of the operating panel.

In the recording device, a plug member which is capable of closing a plug of the pouring port of the liquid containing body may be provided on the operating panel.

According to the configuration, the plug member can be attached to and detached from the liquid containing body according to the opening/closing operation of the operating panel.

In the recording device, the liquid containing body may be disposed on a corner of the inside of the casing.

According to the configuration, it is possible to easily access to the liquid containing body, when performing the opening operation of the operating panel.

In addition, the recording device includes a recording portion that performs recording using liquid; a liquid containing body that is capable of accommodating liquid supplied to the recording portion; a casing on which a moving body on which the recording portion and the liquid containing body are mounted and which is capable of moving is provided an inside portion thereof; and a operating panel that constitutes a portion of an outer covering of the recording device and operates at least one of the recording device and an image reading device. The operating panel is provided to be capable of performing an opening/closing operation with respect to the casing between two positions which are an opened position which exposes and a closed position which does not expose an inside of the casing, the liquid containing body includes a pouring port which is capable of pouring liquid into the inside portion thereof, and the pouring port is exposed, by an opening operation of the operating panel.

According to the configuration, the liquid containing body disposed in the casing is exposed, by the opening operation of the operating panel, in a state of being mounted on the moving body. Therefore, it is possible to easily access to the liquid containing body which accommodates a recording liquid and is provided on the inside portion of the recording device of which the image reading device is disposed on the upper side. In addition, liquid is capable of being easily poured into the liquid containing body by the pouring port of the liquid containing body being exposed.

In the recording device, the operating panel may be provided on a front surface of the casing which is a surface on which a discharge port for discharging a medium on which the recording is performed by the recording portion to an outside of the casing is provided, in the casing.

According to the configuration, visibility of the operating panel can be improved in a front view thereof.

In the recording device, the recording device may further include an image reading device that performs reading of an image. The operating panel may be disposed on a position which is an upper portion of the casing and is adjacent to the image reading device.

According to the configuration, visibility of the operating panel can be improved in a top view thereof.

In the recording device, the recording device may include a transport path on which the medium is transported in the inside of the casing, and at least a portion of the transport path may be exposed, by the opening operation of the operating panel.

According to the configuration, it is possible to access to the transport path in the casing without an opening operation of the image reading device, by the opening operation of the operating panel. In other words, it is possible to easily remove a medium of which transport failure is generated, by the opening operation of the operating panel, when the transport failure of the medium is generated in the transport path, for example.

In the recording device, the recording device may further include a detecting sensor that detects an opening/closing state of the operating panel.

According to the configuration, the operation of the recording device can be controlled, based on the detection result of the opening/closing state of the operating panel.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of a multifunction peripheral will be described with reference to the drawings.

Figure 1:
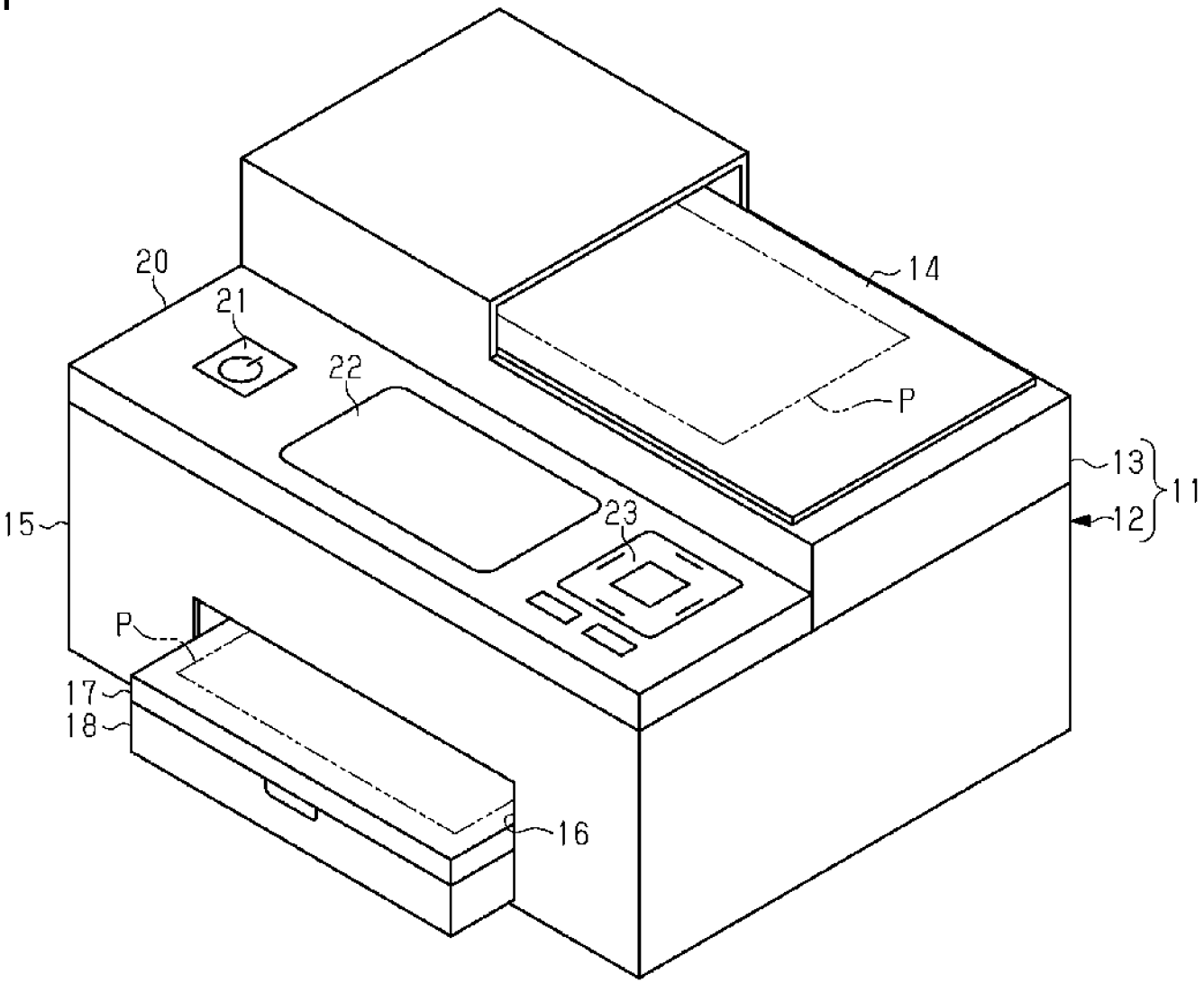
FIG. 1 is a perspective view schematically illustrating a multifunction peripheral according to a first embodiment.

As illustrated in FIG. 1, the multifunction peripheral 11 includes a recording device 12 that performs recording to paper P which is an example of a medium; and an image reading device 13 that is disposed on an upper portion of the recording device 12. The image reading device 13 is configured by a scanner or the like, for example, and is provided to automatically feed documents mounted on a mounting base 14 and to be readable an image of text, picture, or the like which is recorded on the documents. On the other hand, the recording device 12 includes a casing 15 having a rectangular parallelepiped shape. A discharge port 16 which discharges paper P from an inside of the casing 15 to an outside of the casing 15 is opened in a surface of the casing 15 (surface toward a left front side in FIG. 1). Here, a surface on which the discharge port 16 is provided in the casing 15 refers to as a front surface of the multifunction peripheral 11 and a surface which is opposite side to the front surface refers to as a rear surface of the multifunction peripheral 11.

A discharge tray 17 on which paper P discharged from the inside of the casing 15 is mounted is provided to extend from the inside of the casing 15 toward a front side of the recording device 12 through the discharge port 16 in the front surface of the casing 15. In addition, a medium cassette 18 on which paper P is mounted in a stacked state is mounted on the casing 15 to be overlapped with the discharge tray 17 in a lower side of the discharge tray 17. Accordingly, a operating panel 20 for operating a recording operation which is performed by the recording device 12 and a reading operation which is performed by the image reading device 13 is provided on the position which is closer to a front surface of the recording device 12 on an upper portion of the casing 15.

The operating panel 20 is disposed to be parallel to the image reading device 13 and to be adjacent to the image reading device 13 along a direction toward a front surface side from a rear surface side of the recording device 12 on the upper portion of the casing 15. In other words, the image reading device 13 and the operating panel 20 which are provided on the upper portion of the casing 15 of the recording device 12 is disposed to cover the upper portion of the casing 15, in a top view of the multifunction peripheral 11. The operating panel 20 includes a power button 21, a display screen 22, a operating button 23, or the like, for example and constitutes a portion of an outer covering of the recording device 12 as a portion of the upper surface of the casing 15.

Figure 2:
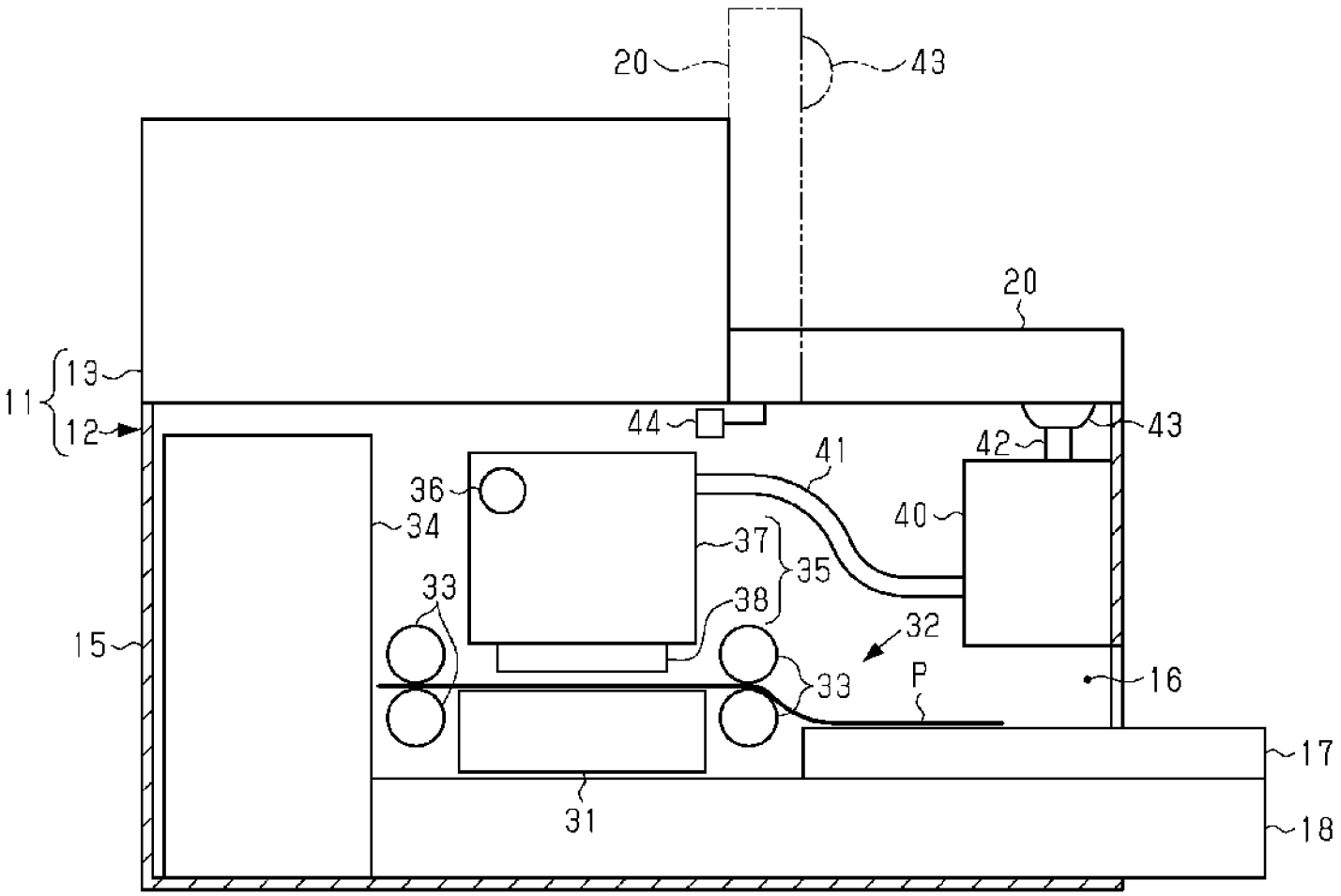
FIG. 2 is a partial side sectional view schematically illustrating a portion of an inside of the multifunction peripheral according to the first embodiment.

As illustrated in FIG. 2, a supporting base 31 which supports paper P from the lower side and a plurality of rollers 33 which are transports paper P along a transport path 32 including an upper surface of the supporting base 31 are provided on the inside of the casing 15 of the recording device 12. The rollers 33 transport paper P in the direction toward the right side from the left side in FIG. 2, by sandwiching paper P between upper rollers and lower rollers and rotating and driving. In other words, a direction toward front surface side from the rear surface side of the recording device 12 is a transport direction of paper P.

In addition, an automatic paper supplying portion 34 which automatically supplies paper P disposed on the medium cassette 18 toward the transport path 32 one by one is provided on a position which is closer to the rear surface of the recording device 12 which is a upstream side in the transport direction of paper P in the inside of the casing 15. Paper P supplied by the automatic paper supplying portion 34 is transported along an upper surface of the supporting base 31 and an upper surface of the discharge tray 17 by the rollers 33. In other words, the supporting base 31 and the discharge tray 17 constitute the transport path 32. The rollers 33 which transports paper P along the transport path 32 are disposed to vertically face each other on a position which is between the automatic paper supplying portion 34 and the supporting base 31 and a position which is between the supporting base 31 and the discharge tray 17, respectively, in the transport direction of paper P.

A recording unit 35 which performs recording on paper P using ink which is an example of liquid is provided on an upper side of the supporting base 31 in the inside of the casing 15. The recording unit 35 includes a carriage 37 which is an example of a moving body supported to a guide shaft 36 which extends toward a scanning direction intersecting with the transport direction of paper P and a recording head 38 which is mounted on the carriage 37 and is as an example of the recording portion discharging ink to paper P. In other words, the recording device 12 according to the embodiment is configured as an ink jet type printer. The carriage 37 is capable of reciprocating along the guide shaft 36 and scanning the upper side of paper P supported by the supporting base 31. Accordingly, the recording head 38 which is mounted on the carriage 37 discharges ink to paper P which is supported on the supporting base 31. In other words, the recording unit 35 can perform performing recording over substantially entire area of paper P which is transported along the transport path 32, by the carriage 37 which mounts the recording head 38 being moved along the scanning direction.

A liquid containing body 40 which is capable of accommodating ink is disposed on a position which is closer to the front surface of the recording device 12 which is a downstream side in the transport direction of paper P in the inside of the casing 15. The liquid containing body 40 is configured as a container made of resin material such as an ink tank, for example and connects with the recording head 38 by a tube 41 having flexibility. Therefore, ink can be supplied from the liquid containing body 40 side toward the recording head 38 side through the tube 41. In other words, the liquid containing body 40 is provided to be capable of accommodating ink supplied to the recording head 38 and is configured as a so-called off-carriage type which is disposed on a predetermined position in the inside of the casing 15. In addition, a pouring port 42 is provided to be capable of pouring ink into the inside of the liquid containing body 40 in an upper portion of the liquid containing body 40. The pouring port 42 projects to the upper side and is closed by a plug member 43 attached to a lower surface of the operating panel 20 facing the liquid containing body 40. The plug member 43 is made of elastic material such as rubber, for example and is biased to the pouring port 42 by the operating panel 20.

The operating panel 20 is provided to be rotatable about the casing 15, by a hinge or the like, for example. In the present embodiment, the operating panel 20 is rotatable (opening/closing operation) between two positions which are an opened position which exposes the inside of the casing 15 (position indicated with a two-dot chain line in FIG. 2) and a closed position which does not expose the inside of the casing 15 (position indicated with a solid line in FIG. 2) about an end portion as a supporting point which is the upstream side in the transport direction of paper P. Therefore, a portion in the inside of casing 15 of the recording device 12 is exposed, by the opening operation of the operating panel 20 from the closed position indicated with a solid line to the opened position indicated with a two-dot chain line in FIG. 2. In other words, the operating panel 20 also functions as a cover which covers a portion in the upper portion of the casing 15, by being provided to be capable of performing the opening/closing operation with respect to the casing 15. In the present embodiment, the image reading device 13 also is provided to be rotatable about the recording device 12 by a hinge or the like for example, as in the case of the operating panel 20. The inside of the casing 15 is exposed by the opening operation of the image reading device 13 with respect to the recording device 12.

The liquid containing body 40 which accommodates ink and the discharge tray 17 which constitutes a portion of the transport path 32 are exposed, in a top view of the multifunction peripheral 11, when the inside of the casing 15 is exposed, by the opening operation of the operating panel 20. In addition, the plug member 43 which is biased to the pouring port 42 by the operating panel 20 is spaced apart from the pouring port 42, by the opening operation of the operating panel 20. The closed pouring port 42 is opened by the plug member 43 being spaced apart from the pouring port 42. In other words, attachment and detachment of the plug member 43 is performed according to the opening/closing operation of the operating panel 20. In addition, a detecting sensor 44 which detects the opening/closing state of the operating panel 20 is provided on the operating panel 20. In the present embodiment, the operation of the multifunction peripheral 11 is controlled, based on a detecting signal of the detecting sensor 44 so that the multifunction peripheral 11 does not perform the recording operation of the recording device 12 in a state where the operating panel 20 is in the opened position by a control unit (not illustrated). In other words, in the present embodiment, the recording device 12 is controlled to perform the recording operation in a state where the pouring port 42 of the liquid containing body 40 is closed and the inside of the casing 15 is not exposed.

Figure 3:
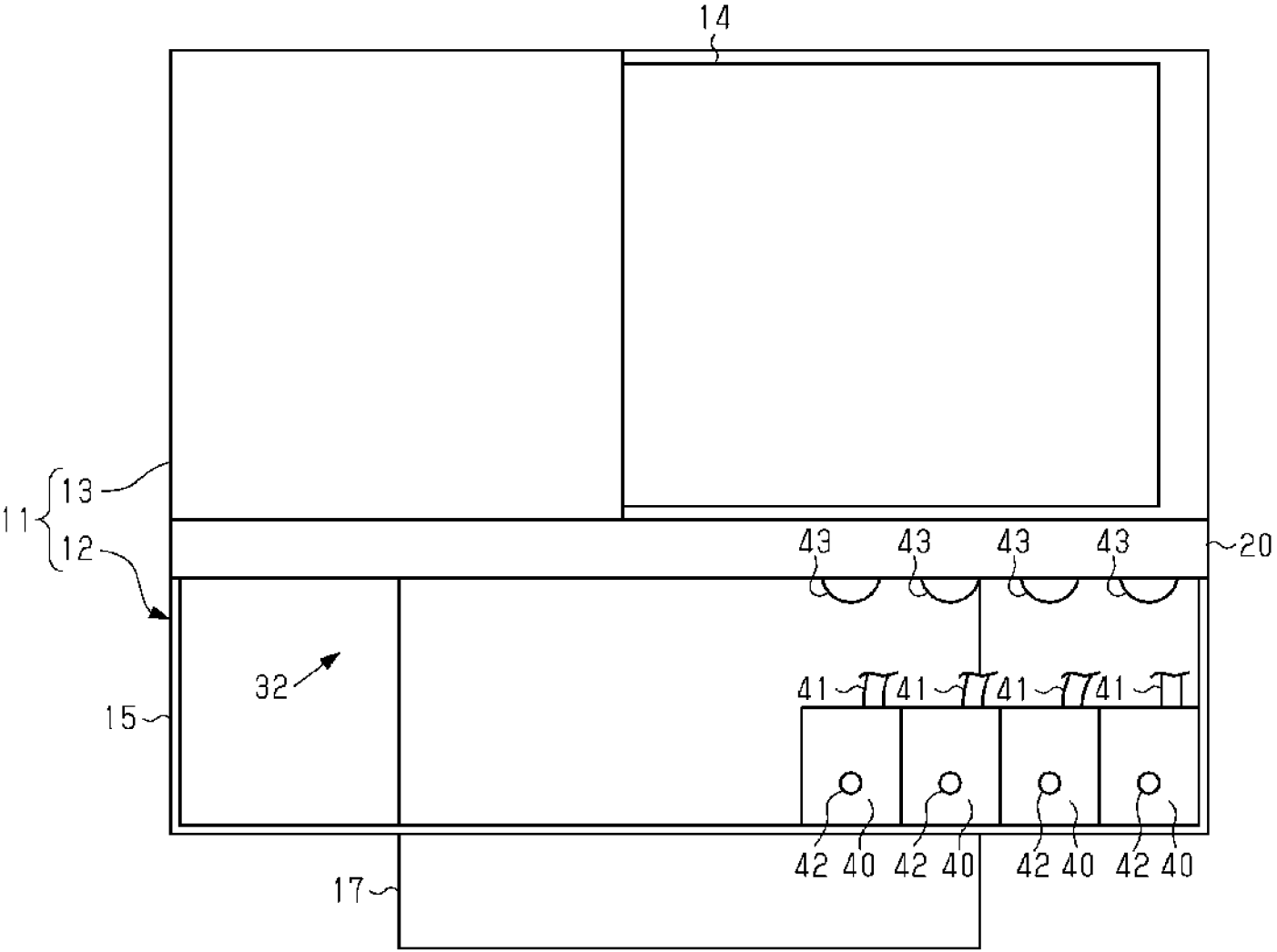
FIG. 3 is a top view schematically illustrating the multifunction peripheral according to the first embodiment in a state where a operating panel is in an opened position.

As illustrated in FIG. 3, a plurality of liquid containing bodys 40 which are disposed in the inside of the casing 15 of the recording device 12 are provided. In the present embodiment, four liquid containing bodys 40 which are disposed on a corner of the inside of the casing 15 which is the front surface side of the recording device 12 and is an end side (right side in FIG. 3) of the scanning direction are provided to be parallel to each other along the scanning direction which intersects with the transport direction of the paper P. The liquid containing bodys 40 accommodates ink having colors which are different from each other, respectively and supply ink to the recording head 38 through the tubes 41 which are each provided individually. In addition, four plug members 43 which close the plug of the pouring ports 42 of the liquid containing bodys 40 are attached to be parallel to the operating panel 20 according to the number of the liquid containing bodys 40.

Next, operations of the multifunction peripheral 11 configured as described above will be described.

As illustrated in FIG. 2 and FIG. 3, first, the operating panel 20 performs the opening operation from the closed position to the opened position, when ink is poured into the liquid containing bodys 40 included in the recording device 12 which constitutes the multifunction peripheral 11. It is possible to access to the liquid containing bodys 40 from the outside of the casing 15 by the liquid containing bodys 40 disposed on the corner of inside of the casing 15 being exposed, by the opening operation of the operating panel 20. At this time, the plugs of the pouring ports 42 included in the liquid containing bodys 40 respectively are opened by the plug members 43 being removed all at once from the pouring port 42, by the opening operation of the operating panel 20. In other words, it is possible to pour of ink into the liquid containing bodys 40 through the pouring ports 42 which are exposed, by the opening operation of the operating panel 20. In addition, it is possible to remove paper P from the upper portion of the casing 15 even in a case where transport failure such as jamming of paper P at the transport path 32 is generated, for example, since a portion of the discharge tray 17 constituting a portion of the transport path 32 is exposed, by the opening operation of the operating panel 20.

In general, a burden of a user which performs the opening/closing operation is reduced since the operating panel 20 has a low weight compared to the image reading device 13 constituted by a scanner or the like. In other words, the burden of the user is reduced since it is not necessary to perform the opening operation of the image reading device 13, when the recording device 12 constituting the multifunction peripheral 11 is maintained such as pouring of ink, removal of paper P, or the like.

According to the above embodiment, following effects can be obtained.

(1) The liquid containing body 40 which is disposed on the inside of the casing 15 is exposed without the opening operation of the image reading device 13 by the opening operation the operating panel 20. Therefore, it is possible to easily access to the liquid containing body 40 which accommodates ink and is provided on the inside portion of the recording device 12 of which the image reading device 13 is disposed on the upper side.

(2) It is possible to pour ink into the liquid containing body 40 which is disposed in the inside of the casing 15 without the opening operation of the image reading device 13 since the pouring port 42 which is included in the liquid containing body 40 is exposed, by the opening operation of the operating panel 20.

(3) The plug member 43 is attached to and detached from the liquid containing body 40 according to the opening/closing operation of the operating panel 20, by the plug member 43 being attached to the operating panel 20.

(4) It is configured to further easily access to the liquid containing body 40, when performing the opening operation of the operating panel 20, by the liquid containing body 40 being disposed on the corner of the inside of the casing 15.

(5) Visibility of the operating panel 20 can be improved, in a top view of the multifunction peripheral 11, by the operating panel 20 being provided on the position which is adjacent to the image reading device 13 in the upper portion of the casing 15.

(6) It is possible to access to the transport path 32 without opening operation of the image reading device 13, since the discharge tray 17 which is a portion of the transport path 32 is exposed, by the opening operation of the operating panel 20. In other words, it is possible to easily remove paper P of which transport failure is generated, by the opening operation of the operating panel 20, when the transport failure of paper P is generated in the transport path 32, for example.

(7) It is possible to control the operation of the multifunction peripheral 11, based on the opening/closing state of the operating panel 20 by the detecting sensor 44 being provided.

(8) It is possible to inhibit reduction of recording quality by dust in the air being attached to the recording head 38 which is disposed in the inside of the casing 15 or dust in the air being incorporated into the inside of the liquid containing body 40 by the recording device 12 being controlled to perform the recording operation when the operating panel 20 is in the closed position.

Second Embodiment

Next, a second embodiment of the multifunction peripheral 11 will be described. In the multifunction peripheral 11 according to the second embodiment, the disposition of the operating panel 20 is different from that in the first embodiment and the other configurations are the same as those of the first embodiment. Therefore, the description of the portions provided with the same configuration will be omitted.

Figure 4:
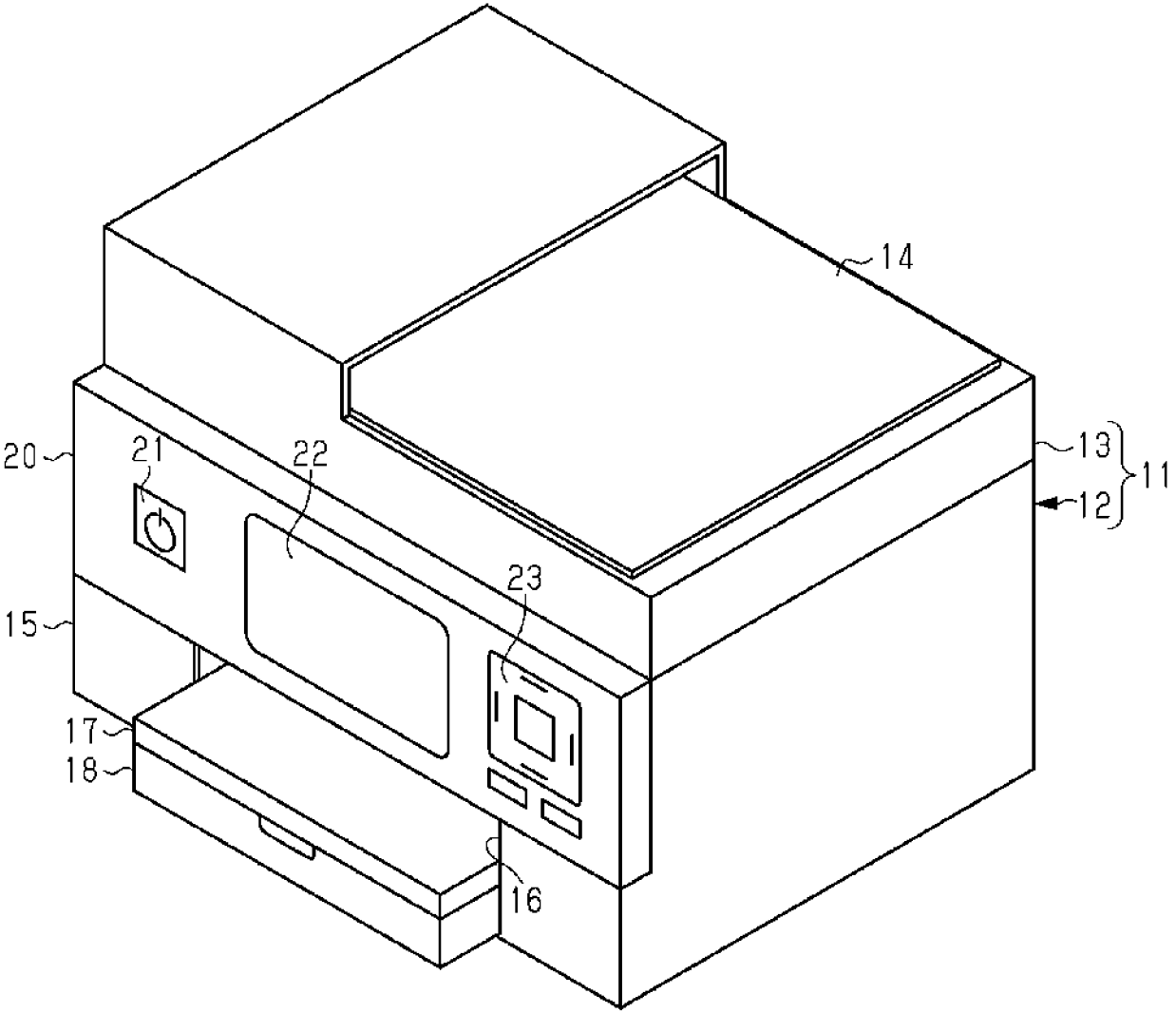
FIG. 4 is a perspective view schematically illustrating a multifunction peripheral according to a second embodiment.
Figure 5:
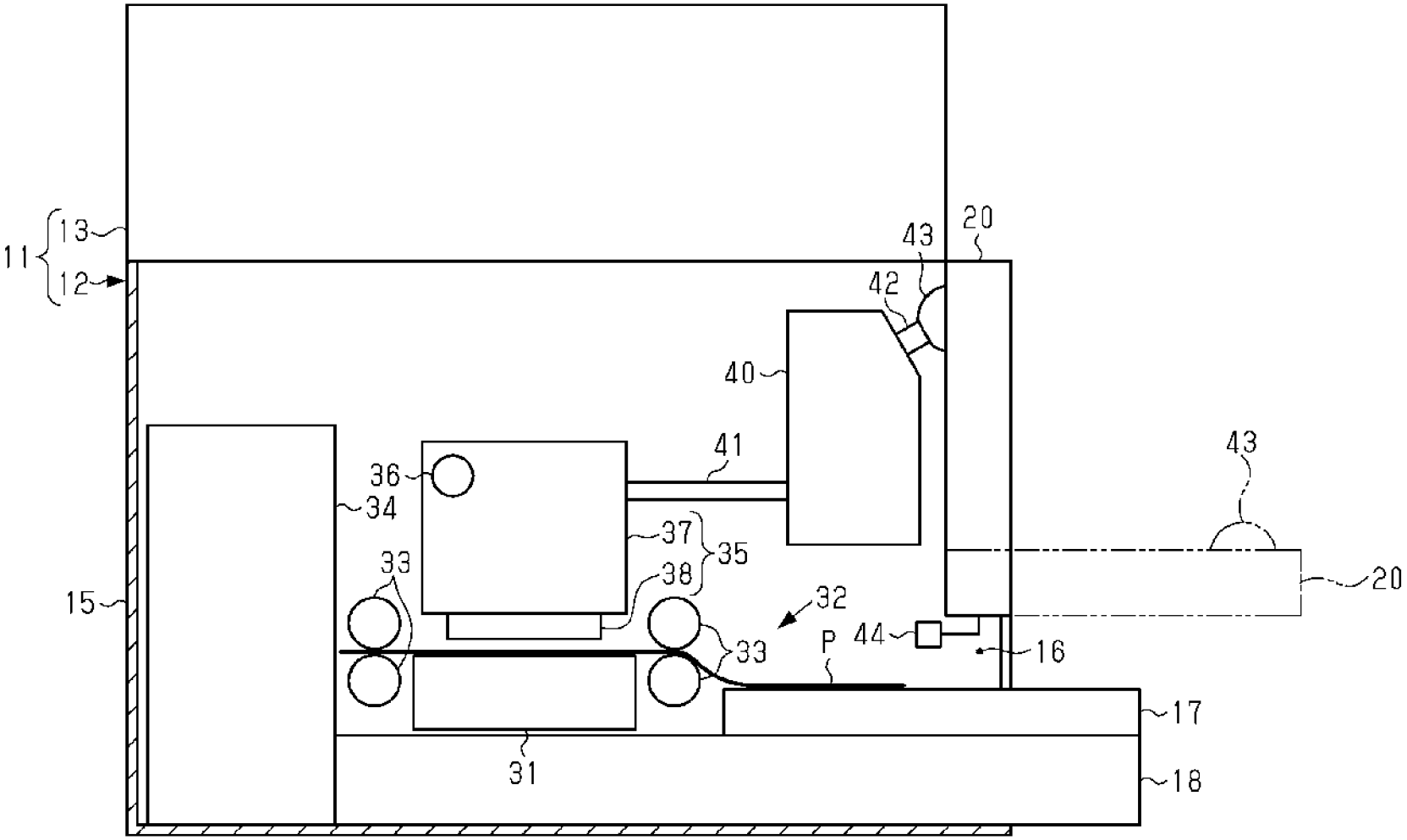
FIG. 5 is a partial side sectional view schematically illustrating a portion of an inside of the multifunction peripheral according to the second embodiment.

As illustrated in FIG. 4 and FIG. 5, the operating panel 20 for operating the recording device 12 and the image reading device 13 constituting the multifunction peripheral 11 is provided on the upper side than the discharge port 16 through which paper P is discharged from the inside of the casing 15 in the front surface of the casing 15. In other words, the operating panel 20 constitutes a portion of an outer covering of the recording device 12 as a portion of the front surface of the casing 15 and a lower edge of the operating panel 20 constitutes a upper edge of the discharge port 16. In addition, the operating panel 20 is provided to be rotatable about an end portion as a supporting point which is a lower end in the vertical direction by a hinge or the like, for example. Therefore, a portion of the recording device 12 in the inside of the casing 15 is exposed, by the opening operation of the operating panel 20 from the closed position indicated with a solid line to the opened position indicated with a two-dot chain line in FIG. 5. In other words, the operating panel 20 also functions as a cover which covers a portion of the front side of the casing 15, by the operating panel 20 being provided to be capable of performing the opening/closing operation with respect to the casing 15.

The liquid containing body 40 is disposed to face the rear surface of the operating panel 20 in a position which is closer to the front surface of the recording device 12 in the inside of the casing 15. In addition, the pouring port 42 which is capable of pouring ink into the inside of the liquid containing body 40 is provided in the front side and the upper portion of the liquid containing body 40. The pouring port 42 projects in an inclined front side toward the upper side and the plug thereof is closed by the plug member 43 attached to the rear surface of the operating panel 20 facing the liquid containing body 40, when the operating panel 20 is in the closed position. In other words, the plug of the pouring port 42 of the liquid containing body 40 is opened by the opening operation of the operating panel 20 from the closed position and the plug of the pouring port 42 of the liquid containing body 40 is closed by the closing operation of the operating panel 20 to the closed position.

According to the second embodiment, the following effects are obtained in addition to the effects of the first embodiment.

(9) Visibility of the operating panel 20 can be improved, in a front view of the multifunction peripheral 11 by providing the operating panel 20 in the front surface of the casing 15.

Third Embodiment

Next, a third embodiment of the multifunction peripheral 11 will be described. In the multifunction peripheral 11 according to the third embodiment, the disposition of the operating panel 20 is different from that in the first embodiment and the other configurations are the same as those of the first embodiment. Therefore, the description of the portions provided with the same configuration will be omitted.

Figure 6:
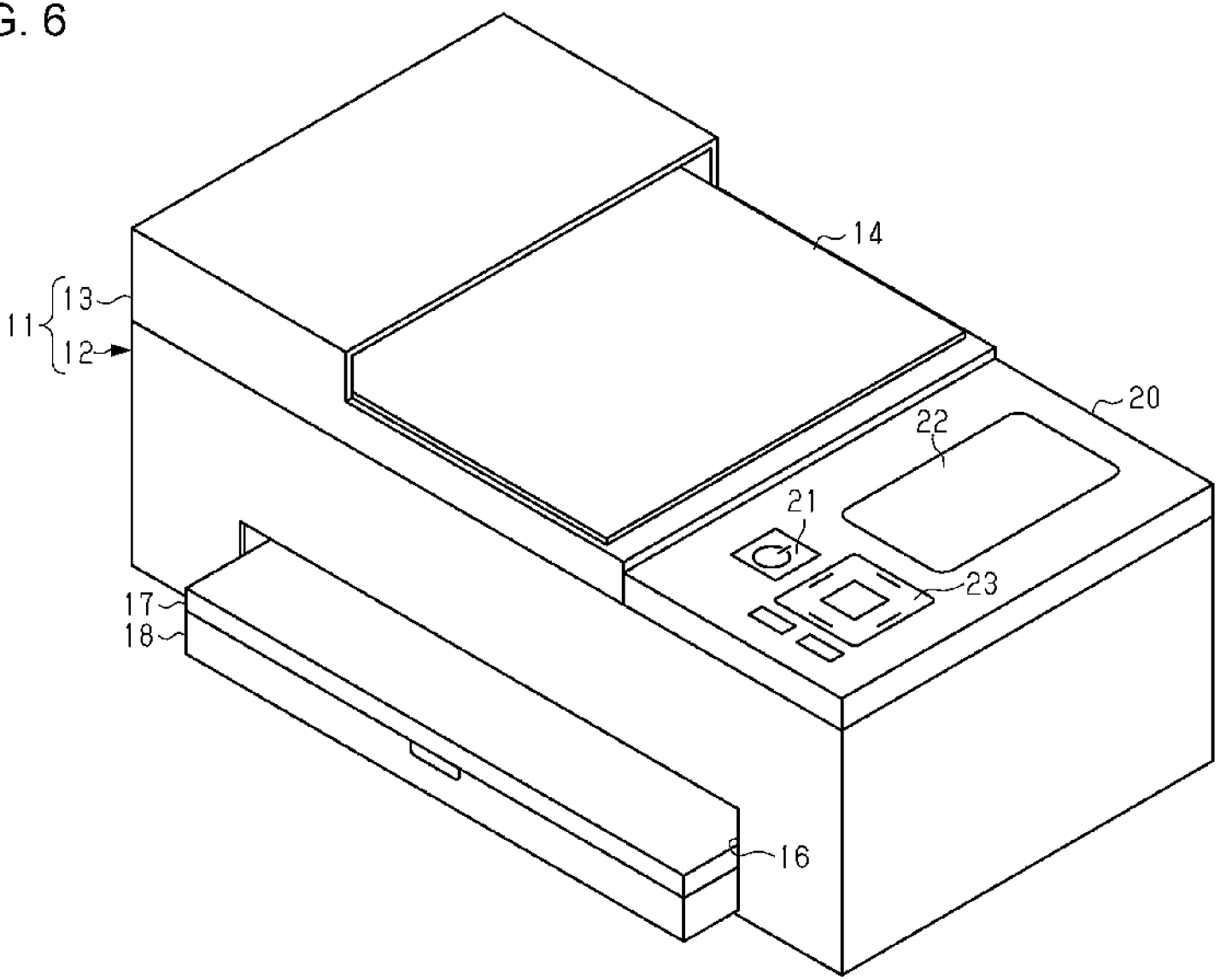
FIG. 6 is a perspective view schematically illustrating a multifunction peripheral according to a third embodiment.
Figure 7:
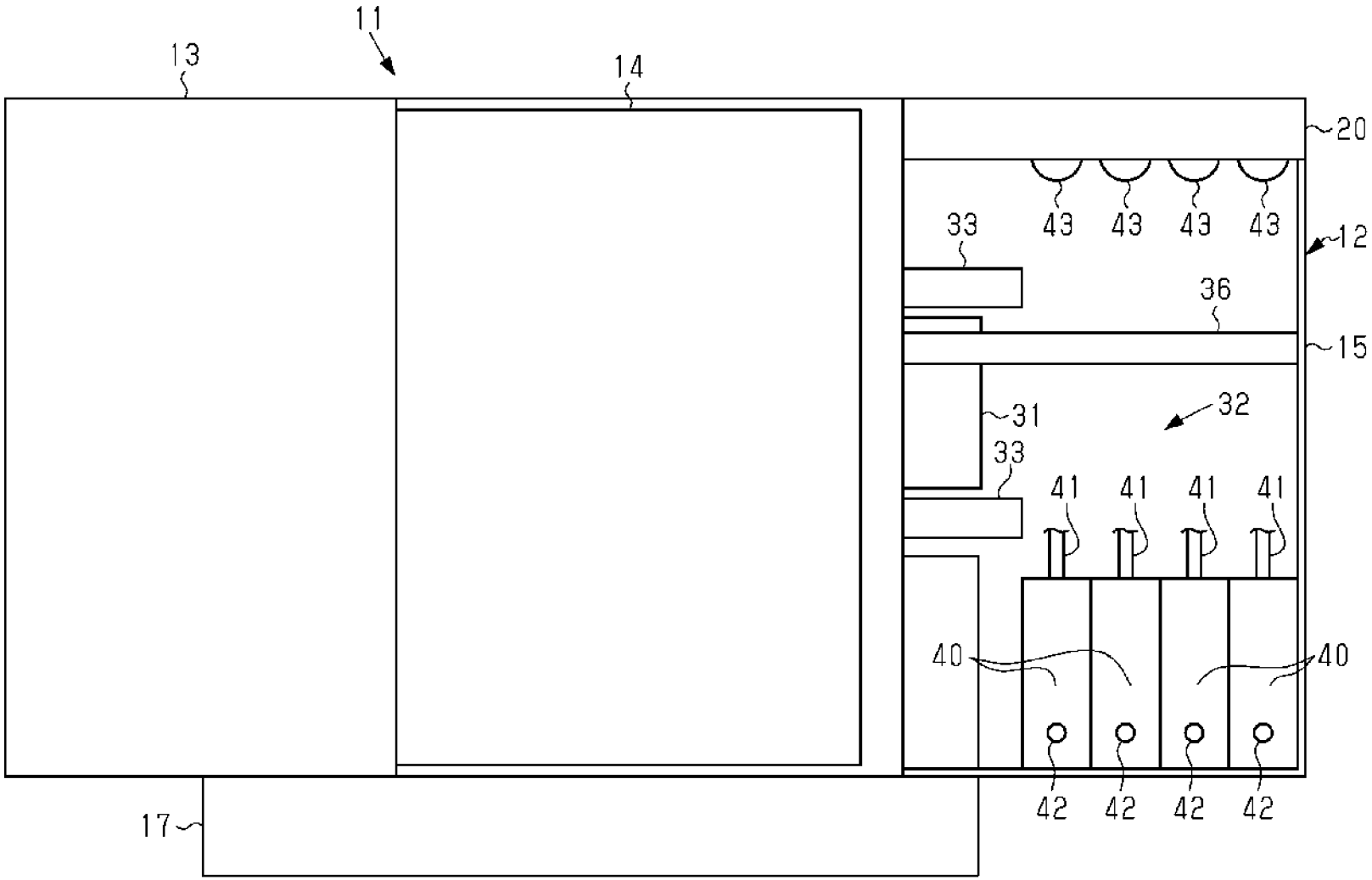
FIG. 7 is a top view schematically illustrating the multifunction peripheral according to the third embodiment in a state where a operating panel is in an opened position.

As illustrated in FIG. 6 and FIG. 7, the operating panel 20 for operating the recording device 12 and the image reading device 13 constituting the multifunction peripheral 11 is provided on the upper portion of the casing 15. Specifically, the operating panel 20 is provided on an end side (right side in FIG. 7) of the scanning direction which intersects with the transport direction of paper P and is disposed to be parallel and to be adjacent to the image reading device 13 in the upper portion of the casing 15. In other words, the operating panel 20 constitutes a portion of an outer covering of the recording device 12 as a portion of the upper surface of the casing.

In addition, the operating panel 20 is provided to be rotatable about an end portion as a supporting point which is on an upstream side (upper side in FIG. 7) in the transport direction of paper P by a hinge or the like, for example. Therefore, a portion of the recording device 12 in the inside of the casing 15 is exposed by an opening operation of the operating panel 20 from the closed position indicated in FIG. 6 to the opened position indicated in FIG. 7. In other words, the operating panel 20 also functions as a cover which covers a portion of the upper portion of the casing 15, by the operating panel 20 being provided to be capable of being performed the opening/closing operation with respect to the casing 15. The plug member 43 attached to the lower surface of the operating panel 20 is spaced apart from the pouring port 42 of the liquid containing body 40 and thus the plug of the pouring port 42 is opened by the opening operation of the operating panel 20. Meanwhile, the plug member 43 is biased to the pouring port 42 and thus the plug of the pouring port 42 is closed by the closing operation of the operating panel 20.

In addition, not only the liquid containing body 40 is exposed, but also the discharge tray 17, the supporting base 31, the rollers 33 and a portion (right side portion in FIG. 7) of the guide shaft 36 which are provided in the casing 15 are also exposed, by the opening operation of the operating panel 20. In other words, paper P can be removed even if the transport failure of the paper P is generated in the supporting base 31 constituting a portion of the transport path 32. Further, the recording unit 35 can be also exposed by the recording unit 35 being positioned on an end side (right side in FIG. 7) in the scanning direction in the guide shaft 36, since a portion of the guide shaft 36 is exposed.

According to the third embodiment, the following effects are obtained in addition to the effects of the first embodiment.

(10) Paper P can be easily removed even if the transport failure of the paper P is generated between the supporting base 31 and the recording unit 35, since the supporting base 31 constituting the transport path 32 is exposed.

(11) Maintenance of the recording unit 35 can be performed, by the opening operation of the operating panel 20, since the recording unit 35 is provided to be exposed.

The first to third embodiments described above may be modified as follows. In addition, the following modification examples for the above each embodiment may be suitably combined.

Figure 8:
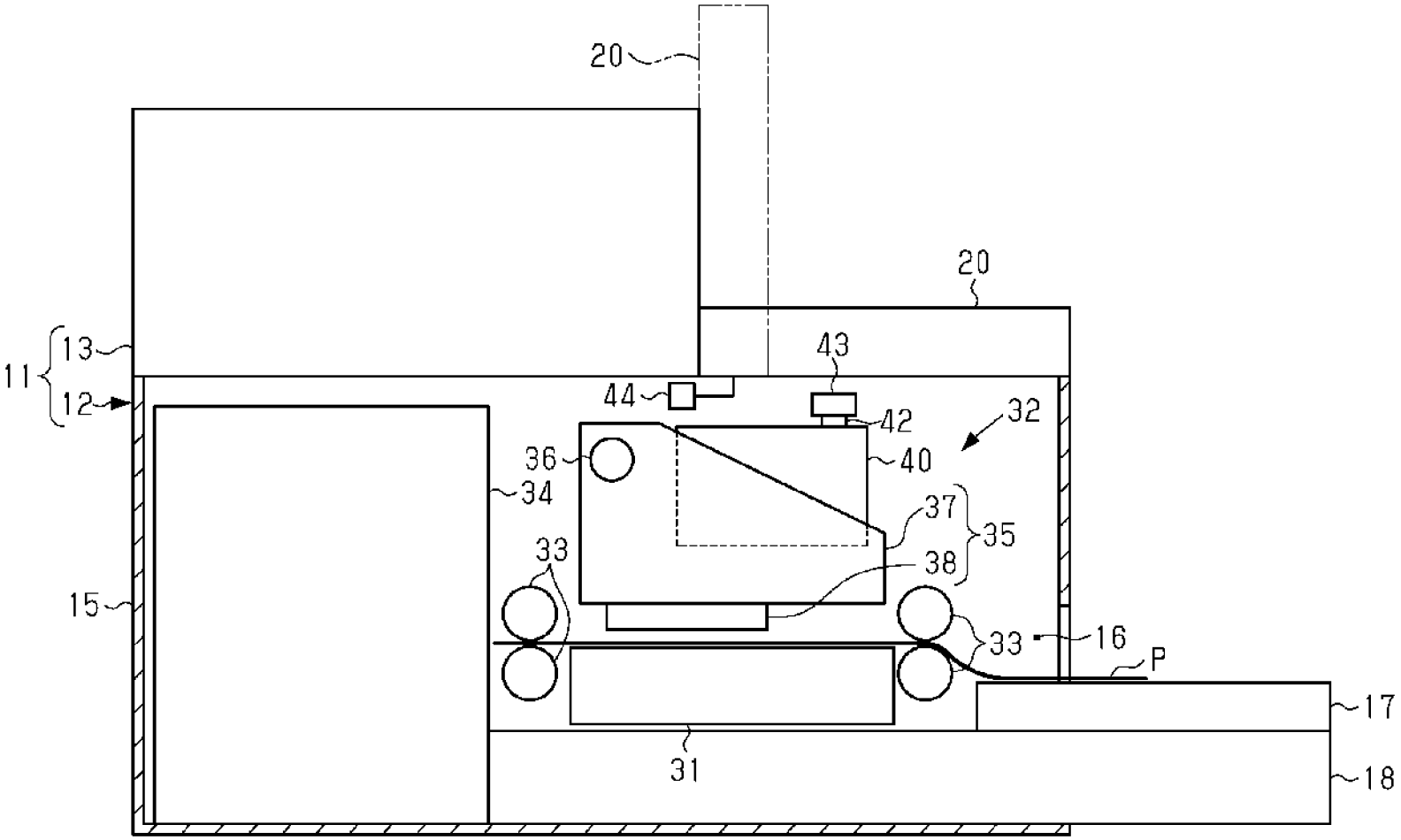
FIG. 8 is a partial side sectional view schematically illustrating the multifunction peripheral according to a modification example of the first embodiment.
Figure 9:
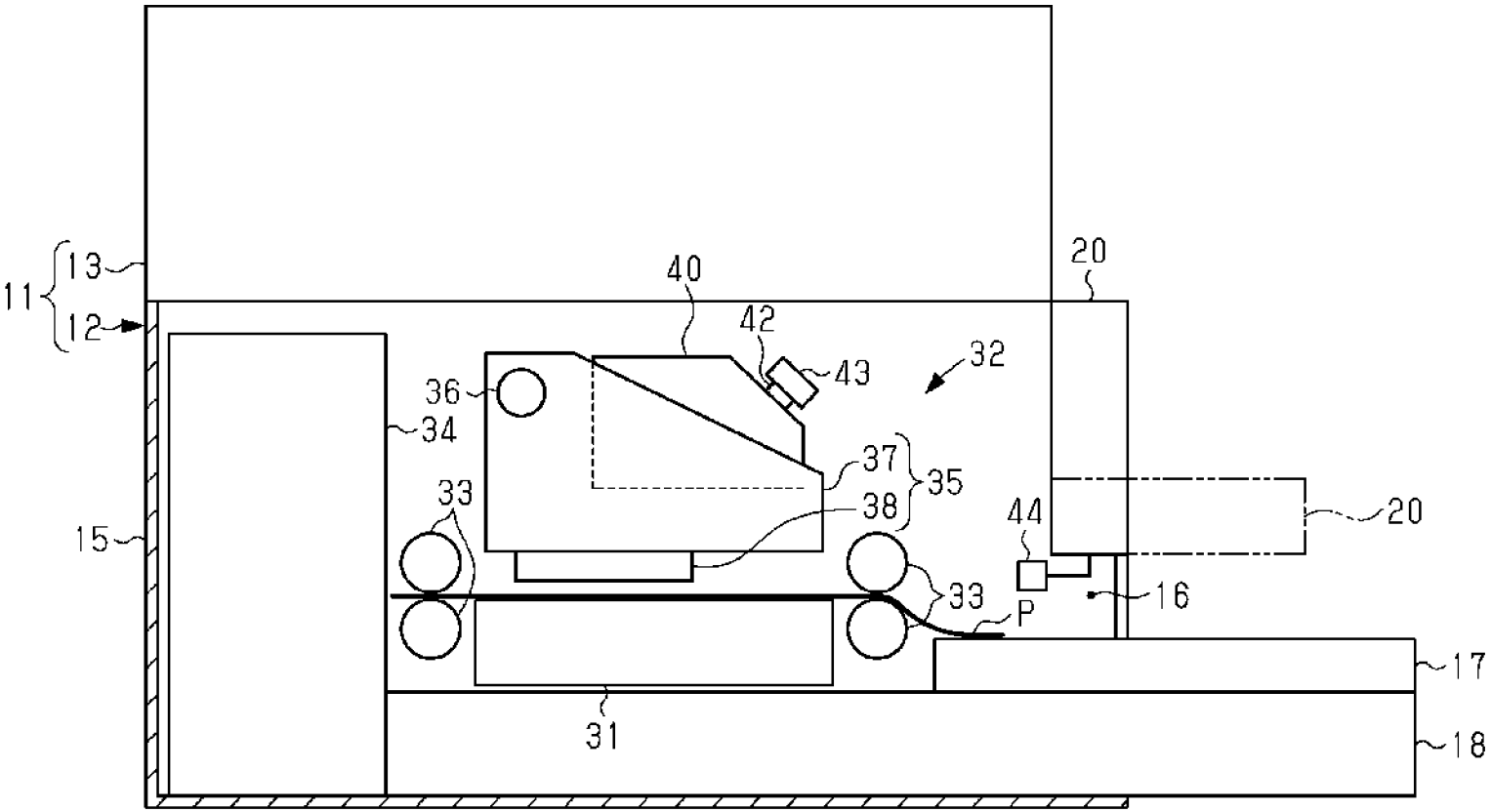
FIG. 9 is a partial side sectional view schematically illustrating the multifunction peripheral according to a modification example of the second embodiment.
Figure 10:
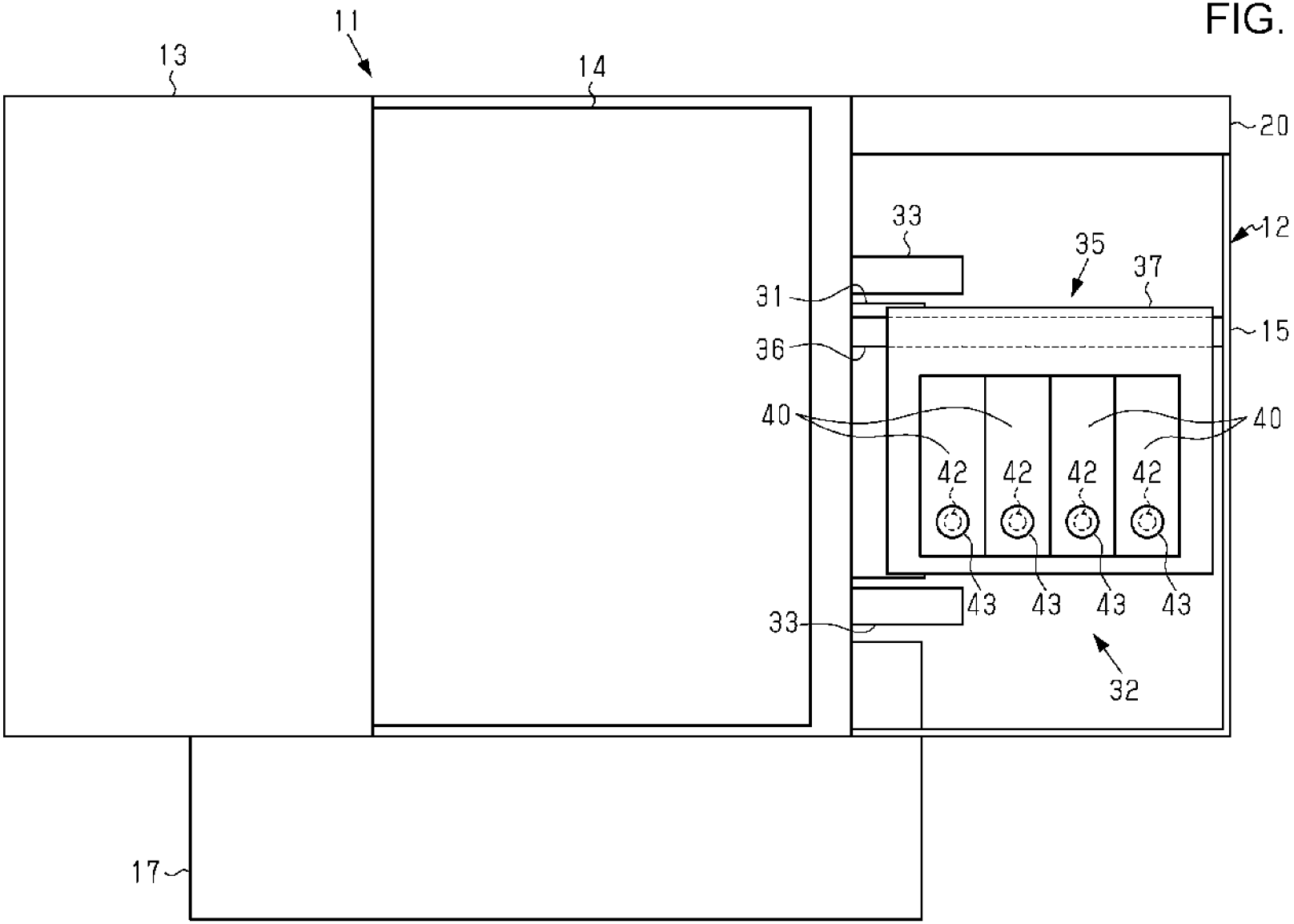
FIG. 10 is a top view schematically illustrating the multifunction peripheral according to a modification example of the third embodiment.

As illustrated in FIG. 8, FIG. 9 and FIG. 10, in each of the first to third embodiments, the liquid containing body 40 which is capable of accommodating ink in the inside thereof may be configured as that of a so-called on-carriage type which is capable of being mounted on the carriage 37 constituting the recording unit 35. In other words, the liquid containing body 40 can be moved with the carriage 37. Therefore, the pouring port 42 of the liquid containing body 40 mounted on the carriage 37 can be exposed, by the opening operation of the operating panel 20. According to the modification example, the following effects are obtained in addition to the effects of the embodiments described above.

(12) The liquid containing body 40 disposed on the inside of the casing 15 is exposed in a state of being mounted on the carriage 37, without an opening operation of the image reading device 13, by the opening operation of the operating panel 20. Therefore, it is possible to easily access to the liquid containing body 40 which accommodates ink and is provided on the inside portion of the recording device 12 of which the image reading device 13 is disposed on the upper side. In addition, it is possible to easily pour ink into the liquid containing body 40 by the pouring port 42 of the liquid containing body 40 being exposed.

In addition, according to the configuration, the configuration can be simplified and an increase in the size of the device can be inhibited, since there is no need of the tube 41 which connects the recording head 38 and the liquid containing body 40 being routed in the casing 15, compared to the multifunction peripheral 11 which adapts a so-called off-carriage type that the liquid containing body 40 is not mounted on the carriage 37.

In addition, as illustrated in FIG. 8, FIG. 9 and FIG. 10, in such a modification example, the plug member 43 is configured to provide independently from the operating panel 20 without being configured that the plug member 43 which closes the plug of the pouring port 42 of the liquid containing body 40 is attached to the operating panel 20. According to the configuration, the plug member 43 can be removed from the pouring port 42 of the desired liquid containing body 40 in a plurality of liquid containing bodys 40 which is exposed, by the opening operation of the operating panel 20 and risks of evaporation of ink accommodated to the other liquid containing body 40 and incorporation of dust in the air into the inside of the liquid containing body 40 are capable of being further reduced. The configuration may be adapted to the liquid containing body of the on-carriage type indicated in the first to third embodiments.

In each embodiment described above, the liquid containing body 40 accommodating ink may not be disposed on the corner of the casing 15, for example, may be a configuration in which the liquid containing body 40 is disposed on the front surface side of the casing 15 and a center position of the scanning direction in the inside of the casing 15. A disposition position of the liquid containing body 40 in the inside of the casing 15 may be a position which is exposed, by the opening operation of the operating panel 20.

In each embodiment described above, the operating panel 20 may be configured to be provided on the side surface or the rear surface of the recording device 12.

In each embodiment described above, an object operated by the operating panel 20 may be only the recording device 12 or may be only the image reading device 13.

In each embodiment described above, the number of the liquid containing body 40 provided may be equal to or less than three or equal to or more than five.

In each embodiment described above, the operating panel 20 may have a configuration which performs the opening/closing operation with respect to the casing 15 by, for example, sliding between two positions which are an opened position and a closed position, without being limited to a configuration which is capable of performing the opening/closing operation with respect to the casing 15 by rotating.

In each embodiment described above, the image reading device 13 may not be provided to be capable of performing the opening/closing operation with respect to the recording device 12. Normally, as in each embodiment described above, a mechanism such as a damper is newly required in order to maintain a posture of the image reading device 13 in a configuration in which the inside of the casing 15 of the recording device 12 is exposed by the image reading device 13 having a heavy weight being rotated about the recording device 12. At this point, if the image reading device 13 is provided to be fixed to the recording device 12, for example, such a mechanism is not required and thus the number of components can be reduced. In this connection, it is not required to provide the mechanism such as the damper to the operating panel 20 since the weight of the operating panel 20 is low.

In each embodiment described above, paper P may be configured to being supplied to the transport path 32 by inserting paper P from the rear surface of the recording device 12.

In each embodiment described above, a portion of the tube 41 may be configured to extend to the outside of the casing 15.

In each embodiment described above, a belt conveyor may be adapted instead of the rollers 33 which transports paper P along the transport path 32.

In each embodiment described above, in the recording unit 35, the recording head 38 may be a line head type in which the recording head 38 is provided longitudinally in a direction which is intersected with the transport direction of paper P, without being limited to a serial head type in which the recording head 38 is moved in the scanning direction.

In each embodiment described above, a medium which performs recording by the recording device 12 may be a fabric or plastic film, without being limited to paper P.

In each embodiment described above, the recording device 12 constituting the multifunction peripheral 11 may be a fluid ejecting device which performs recording by ejecting or discharging another fluid rather than ink (including liquid, a liquid form body in which particles of functional material are dispersed or mixed in liquid or flow form body such as a gel). For example, the recording device 12 may be a liquid form body ejecting device which performs recording by ejecting a liquid form body including forms of dispersing or dissolving material such as electrode material, color material (pixel material) which is used in manufacture, or the like of a liquid crystal display, an electroluminescence (EL) display, and a surface light emitting display. In addition, the recording device 12 may be a fluid form body ejecting device which ejects a fluid form body such as gel (for example, physical gel). Therefore, the invention may be applied to any of these kinds of fluid ejecting devices. The term "fluid" as used herein is a concept that does not include fluid having only gas and for example, includes liquid (including inorganic solvents, organic solvents, solutions, liquid form resins, liquid form metals (metal melt), or the like), the liquid form body, fluid form body, or the like.

This application is a continuation of U.S. application Ser. No. 15/398,526, filed Jan. 4, 2017, which claims priority to Japanese Patent Application No. 2016-015319, filed Jan. 29, 2016 the entireties of which are incorporated by reference herein.

What is claimed is:

1. A recording device, comprising:

a recording portion that performs recording on a medium using a liquid, the recording portion configured to move in a scanning direction during the performance of recording;

a paper supplying portion configured to supply the medium from a paper tray to the recording portion through a transportation path, the paper tray being disposed on a rear side of the recording device;

a liquid containing body that accommodates the liquid supplied to the recording portion;

a casing houses at least the recording portion and the liquid containing body; and an operating panel unit that constitutes a portion of the top of the casing and operates the recording device, the operating panel being provided at an end side of the recording device in the scanning direction, and being adjacent and in parallel to an image reading area in the scanning direction;

wherein the operating panel unit includes a hinge that connects the operating panel unit to the casing, and the hinge is provided at the upstream of the recording portion in a transport direction, such that the operating panel unit is configured to rotate about the hinge to open from a front side, the front side being opposite to the rear side, and the transport direction intersecting the scanning direction; and wherein at least a portion of the liquid containing body is exposed, by an opening operation of the operating panel unit.

2. A recording device, comprising:

a recording portion that performs recording on a medium using a liquid, the recording portion configured to move in a scanning direction during the performance of recording;

a paper supplying portion configured to supply the medium from a paper tray to the recording portion through a transportation path, the paper tray being disposed on a rear side of the recording device;

a liquid containing body that accommodates the liquid supplied to the recording portion;

a pouring port for pouring the liquid;

a plug member for plugging the pouring port;

a casing that houses at least the recording portion and the liquid containing body; and an operating panel unit that constitutes a portion of the top of the casing and operates the recording device, the operating panel being provided at an end side of the recording device in the scanning direction, and being adjacent and in parallel to an image reading area in the scanning direction;

wherein the operating panel unit includes a hinge that connects the operating panel unit to the casing, and the hinge is provided at the upstream of the recording portion in a transport direction, such that the operating panel unit is configured to rotate about the hinge to open from a front side, the front side being opposite to the rear side, and the transport direction intersecting the scanning direction; and wherein the plug member is exposed, by an opening operation of the operating panel unit.

3. A recording device, comprising:

a recording portion that performs recording on a medium using a liquid, the recording portion configured to move in a scanning direction during the performance of recording;

a paper supplying portion configured to supply the medium from a paper tray to the recording portion through a transportation path, the paper tray being disposed on a rear side of the recording device;

a liquid containing body that accommodates the liquid supplied to the recording portion;

a pouring port for pouring the liquid;

a plug member for plugging the pouring port;

a casing that houses at least the recording portion and the liquid containing body are provided on an inside;

an operating panel unit that constitutes a portion of the top of the casing and operates the recording device, the operating panel being provided at an end side of the recording device in the scanning direction, and being adjacent and in parallel to an image reading area in the scanning direction;

wherein the operating panel unit includes a hinge that connects the operating panel unit to the casing, and the hinge is provided at the upstream of the recording portion in a transport direction, such that the operating panel unit is configured to rotate about the hinge to open from a front side, the front side being opposite to the rear side, and the transport direction intersecting the scanning direction; and wherein the liquid can be poured, by opening operation of the operating panel unit.

4. The recording device according to claim 1, wherein a tube that connects the liquid containing body and the recording portion with each other.

5. The recording device according to claim 2, wherein a tube that connects the liquid containing body and the recording portion with each other.

6. The recording device according to claim 3, wherein a tube that connects the liquid containing body and the recording portion with each other.

7. The recording device according to claim 1, wherein a liquid containing body that is in a carriage.

8. The recording device according to claim 2, wherein a liquid containing body that is in a carriage.

9. The recording device according to claim 3, wherein a liquid containing body that is in a carriage.

10. The recording device according to claim 1, wherein the operating panel unit disposed in the right, view from paper discharge port.

11. The recording device according to claim 2, wherein the operating panel unit disposed in the right, view from paper discharge port.

12. The recording device according to claim 3, wherein the operating panel unit disposed in the right, view from paper discharge port.

13. The recording device according to claim 2, wherein a detecting sensor that detects an opening/closing state of the operating panel unit.

14. The recording device according to claim 3, wherein a detecting sensor that detects an opening/closing state of the operating panel unit.

15. The recording device according to claim 1, wherein an image reading device that performs reading of an image;

the image reading device that constitutes a portion of the top of the casing and disposed to be parallel to the operation panel unit.

16. The recording device according to claim 2, wherein an image reading device that performs reading of an image;

the image reading device that constitutes a portion of the top of the casing and disposed to be parallel to the operation panel unit.

17. The recording device according to claim 3, wherein an image reading device that performs reading of an image;

the image reading device that constitutes a portion of the top of the casing and disposed to be parallel to the operation panel unit.

18. The recording device according to claim 1, wherein an opening/closing member that constitutes a portion of the top of the casing and disposed to be parallel to the operation panel unit.

19. The recording device according to claim 2, wherein an opening/closing member that constitutes a portion of the top of the casing and disposed to be parallel to the operation panel unit.

20. The recording device according to claim 3, wherein an opening/closing member that constitutes a portion of the top of the casing and disposed to be parallel to the operation panel unit.

* * * * *